United States Patent [19]

Mackal

[11] Patent Number: 5,076,468

[45] Date of Patent: Dec. 31, 1991

[54] SQUIB INFLATOR ADAPTOR

[75] Inventor: Glenn H. Mackal, St. Petersburg, Fla.

[73] Assignee: Halkey-Roberts Corporation, St. Petersburg, Fla.

[21] Appl. No.: 486,551

[22] Filed: Feb. 28, 1990

[51] Int. Cl.[5] ..... B67D 5/00

[52] U.S. Cl. ..... 222/5; 222/91; 441/93

[58] Field of Search ..... 222/3, 5, 81, 83, 91; 441/24, 92–95

[56] References Cited

U.S. PATENT DOCUMENTS

| | | | |
|---|---|---|---|
| 2,780,389 | 2/1957 | Sandgren | 222/5 |
| 2,894,658 | 7/1959 | Spidy | 222/5 |
| 3,059,814 | 10/1962 | Poncel et al. | 222/5 |
| 3,426,942 | 2/1969 | McMains et al. | 222/5 |
| 3,702,014 | 11/1972 | Rabon et al. | 441/24 X |
| 4,024,440 | 5/1977 | Miller | 441/94 X |
| 4,482,081 | 11/1984 | Meggs | 222/5 |
| 4,493,664 | 1/1985 | Dale | 222/5 X |

*Primary Examiner*—Michael S. Huppert
*Assistant Examiner*—Gregory L. Huson
*Attorney, Agent, or Firm*—Dominik, Stein, Saccocio, Reese, Colitz & Van Ver Wall

[57] ABSTRACT

A squib inflator adaptor for operatively connecting a conventional electrically actuated squib to the threaded neck of a compressed gas cartridge such that upon actuation of the squib, a pierce pin in the adaptor pierces the frangible seal of the gas cartridge allowing the gas therein to escape and inflate the inflation article.

6 Claims, 1 Drawing Sheet

SQUIB INFLATOR ADAPTOR

BACKGROUND OF THE INVENTION

1. Field of the Invention

This invention relates to automatic actuators commonly used in conjunction with inflators for inflating articles such as personal flotation devices, rafts, buoys and emergency signalling equipment. More particularly, this invention relates to electrically actuated squib assemblies designed to pierce the frangible seal of a compressed gas cartridge allowing compressed gas therein to inflate the inflatable article.

2. Description of the Background Art

Presently, there exist many types of inflators designed to inflate inflatable articles such as personal flotation devices (life vests, rings and horseshoes), life rafts, sonobuoys and emergency signaling equipment. These inflators typically comprise a body for receiving the neck of a cartridge of compressed gas such as carbon dioxide. A reciprocating pierce pin is disposed within the body for piercing the frangible seal of the cartridge to permit the compressed gas therein to flow into a manifold in the body and then into the device to be inflated. Typically, a manually movable firing lever is operatively connected to the piercing pin such that the piercing pin pierces the frangible seal of the cartridge upon jerking of a ball lanyard. U.S. Pat. No. 3,809,288, the disclosure of which is hereby incorporated by reference herein, illustrates one particular embodiment of a manual inflator.

While these manual inflators work suitably well, it was quickly learned that in an emergency situation, the person needing the assistance of the inflatable device, such as a downed aviator, injured person, or a man overboard, would fail or be unable to manually actuate the inflator. Accordingly, it was realized that a means should be provided for automatically actuating the inflator in such an emergency situation.

In response to this need, water activated automatic inflators have been developed which, when exposed to a fluid such as water, automatically actuate the piercing pin of the inflator causing inflation of the inflatable device.

One type of water activated automatic inflators comprises a water activated trigger assembly including a water dissolvable element which retains a spring-loaded actuator pin in a cocked position in alignment with the pierce pin, either directly or indirectly by means of an intermediate transfer pin. Upon exposure to water, the element dissolves allowing firing of the cocked actuator pin. The actuator pin then strikes the pierce pin to fracture the seal of the cartridge thereby allowing the gas contained therein to flow into the inflatable device to inflate the same. U.S. Pat. Nos. 3,997,079, 4,223,805 4,267,944, 4,260,075 and 4,627,823 the disclosures of each of which are hereby incorporated by reference herein, illustrate several examples of water activated automatic inflators which employ a dissolvable element.

While the above automatic inflators work quite well to automatically inflate the inflatable device in the event of an emergency situation, one major disadvantage to these automatic inflators is their tendency to self-actuate while stored for subsequent exigent use. Specifically, it is quite common for the automatic inflator to be stored in a highly humid environment such as on a ship or a boat. Over a period of time, the moisture contained within the humid air is absorbed by the water dissolvable element to such a degree that the element is weakened, particularly since the element is continually subjected to the force of the actuator spring. As the element gradually weakens, the strength of the element eventually becomes insufficient to retain the spring-loaded actuator pin in the cocked position. When the element collapses under the force of the compressed spring of the actuator pin, the actuator pin strikes the piercing pin causing premature and unintentional inflation of the inflatable device.

The problem of premature and unintentional actuation of the automatic inflator is so acute that it is not uncommon for a weakened water destructible or dissolvable element to be replaced with a new element on a periodic basis pursuant to a regularly scheduled maintenance plan. In this regard, it is noted that each of the prior art water activated automatic inflators disclosed in the above referenced patents teach a structure which may easily be disassembled to facilitate removal of a weakened element and the installation of a new one. Indeed, U.S. Pat. No. 4,627,823 discloses a safety-latched automatic actuator designed to relieve the pressure exerted on the water dissolvable element until such time as an emergency situation exists.

Another type of water activated automatic inflators comprises a water activated, squib powered inflator. As the term is commonly used, a squib is a self-contained explosive charge. Upon actuation by electric current, the explosive charge explodes and which then actuates the inflator. U.S. Pat. Nos. 3,059,814, 3,091,782, 3,426,942, 3,579,964, 3,702,014, 3,757,371, 3,910,457, 4,382,231, 4,436,159 and 4,513,248, the disclosures of each of which are incorporated by reference herein, illustrate several examples of water activated squib-powered inflators.

While many of the squib-powered inflators disclosed in the above-listed patents suffice for many applications, there exists a need for an inflator adaptor which is compact in design facilitating use of the inflator in a variety of inflation devices. There also exists a need for an inflator adaptor which is simple in construction so as to reduce manufacturing costs. Specifically, there exists a need for an economical and reliable squib-powered inflator used to inflate a sonobuoy. In this regard, a sonobuoy typically comprises an inflatable device which is dropped from an aircraft into a body of water; the device including appropriate electronics to detect submarines and transmit such information to the aircraft overhead. It is believed that such squib-powered inflators have been developed in Europe prior to the invention hereof; however, no specific disclosure of such inflators is known to me other than the brochure attached to the Information Disclosure Statement filed concurrently herewith.

Therefore, an object of this invention is to provide an inflator adaptor having a compact design allowing it to be easily incorporated in a variety of inflation devices.

Another object of this invention is to provide an inflator adaptor having a simple design which is economical to manufacture.

The foregoing has outlined two of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention comprises a squib inflator adaptor for operatively connecting a conventional electrically actuated squib to the threaded neck of a compressed gas cartridge such that upon actuation of the squib, a pierce pin in the adaptor pierces the frangible seal of the gas cartridge allowing the gas therein to escape and inflate the inflation article.

More particularly, the inflator adaptor of the invention comprises a body having a longitudinal bore in which is positioned at the forward end the conventional squib and the reciprocatable pierce pin. The rearward end of the longitudinal bore is threaded for receiving the threaded neck of the conventional compressed gas cartridge. However, preferably, a thin membrane is formed midway in the longitudinal bore between the pierce pin and the compressed gas cartridge so as to hermetically seal the forward portion of the longitudinal bore and prevent moisture or other foreign materials from entering the forward portion of the longitudinal bore. Finally, the forward end of the housing is threaded for threadably receiving a cap. The cap allows access into the housing for installation of the pierce pin and squib during assembly.

During use, upon electrical current being supplied to the terminals of the conventional squib, the squib explodes and forces the pierce pin rearwardly to pierce through the thin membrane and then fracture the frangible seal of the gas cartridge. The escaping gas from the cartridge flows into the longitudinal bore and then into a vent hole formed transversely through the adaptor assembly, thereby inflating the inflatable device.

An important feature of the adaptor assembly of the invention is the compact design which allows the pierce pin and squib to be positioned directly in front of the frangible seal of the gas cartridge, thereby eliminating the bulkiness commonly associated with prior art squib-powered inflators. Furthermore, the compact design of the inflator adaptor of the invention allows it to be easily incorporated in a large variety of inflatable devices such as those disclosed in the above-mentioned patents. Finally, the compact design is simple to manufacture and results in substantial savings in manufacturing costs.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
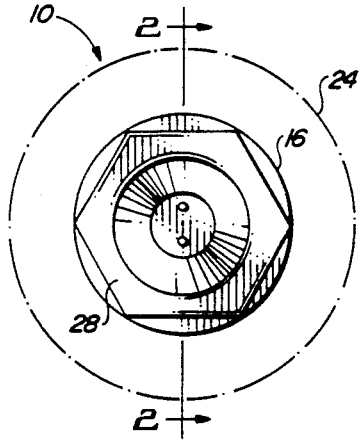
FIG. 1 is an end view of the squib inflator adaptor of the invention illustrating the first embodiment of the squib inflator adaptor of the invention in which the body thereof comprises an integral design.
Figure 2:
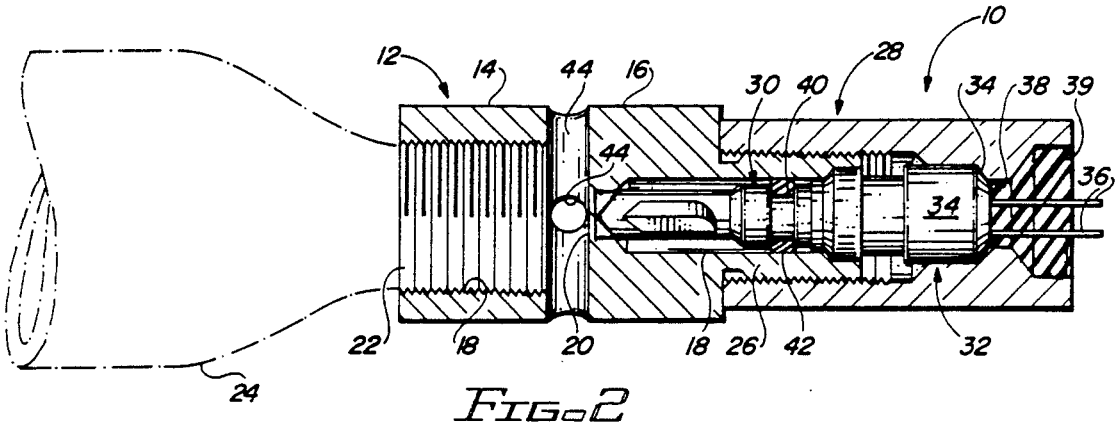
FIG. 2 is a cross-sectional view of FIG. 1 along lines 2—2.

Referring to FIGS. 1 and 2, the squib inflator adaptor 10 of the invention comprises a substantially cylindrical body 12 having a rearward end 14 and a forward end 16, each containing a longitudinal bore 18 separated by a thin membrane 20. The longitudinal bore 18 of the rearward end 14 comprises an increased diameter which is threaded for receiving the threaded neck 22 of a conventional gas cartridge 24. The forward end 16 of the adaptor body 12 comprises an outwardly extending threaded boss 26 with longitudinal bore 18 extending therethrough. Boss 26 is threaded so as to threadably receive hexagonal cap 28.

A pierce pin 30 is positioned within the longitudinal bore 18 of the forward end 16. A conventional squib 32 is positioned forwardly of the pierce pin 30 in longitudinal bore 18. It is noted that cap 28 may include a recess 34 configured to seat the squib 32 therein with the squib's electrical leads 36 extending through hole 38 in the top of the cap 28. It is also noted that hole 38 may be potted with a suitable potting material 39. Pierce pin 30 includes at least one O-ring groove 40 for receiving a conventional O-ring 42 so as to seal against the lumen of the longitudinal bore 18 in the forward end 16.

Finally, the rearward end 14 of the adaptor body 12 further comprises vent holes 44 connected in fluid communication with the longitudinal bore 18 positioned in the forward end 16 of the inflator body 12. As shown in FIG. 2, two vent holes 44 may be formed transversely through the inflator body 12 at right angles to the longitudinal bore 18 and each other.

Figure 3:
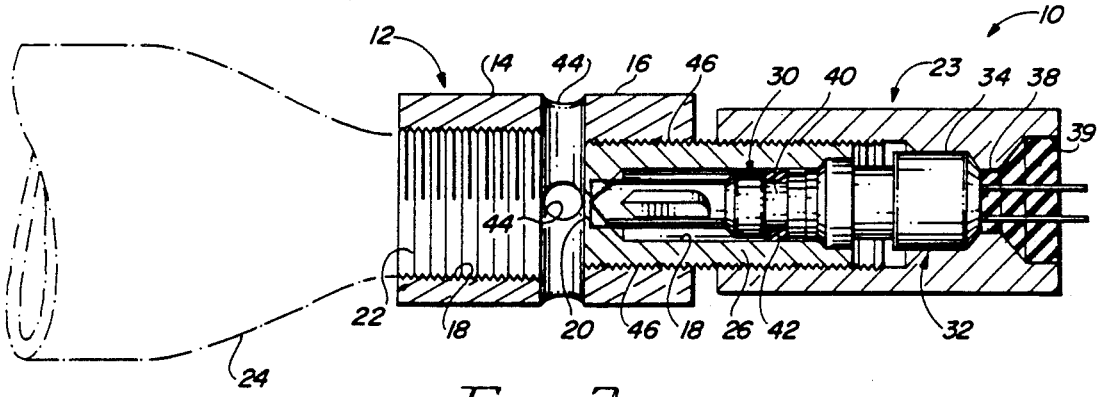
FIG. 3 is a cross-sectional view of the second embodiment of the squib inflator adaptor of the invention in which the body comprises a two component design.

FIG. 3 illustrates a second embodiment of the squib inflator adaptor of the invention in which the inflator body 12 comprises a two component design with the boss 26 being a separate component threaded about its exterior for receiving the cap 28 as described hereinabove and to be threaded into a threaded hole 46 the forward end 16 of the inflator body 12. In this manner, boss 26 includes the transverse thin membrane 20 requiring replacement of only the boss 26 when the membrane 20 being fractured during use.

During use, upon electrical current being supplied to the leads 36 of the squib 32, the squib 32 explodes and creates a high pressure within the longitudinal bore 18 in the forward end 16 of the inflator body 12. The pierce pin 30, being sealed within longitudinal bore 18 by means of O-ring 42, is forcibly urged rearwardly to puncture the thin membrane 20 and to then fracture the frangible seal of the gas cartridge 24. The gas escaping from the cartridge 24 then fills the longitudinal bore 16 in the rearward end 14 of the body 12 and is allowed to vent via vent holes 44 to inflate the inflatable device.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit of the invention.

Now that the invention has been described,

What is claimed is:

1. A squib inflator adaptor for operatively interconnecting an electrically actuable squib with a compressed gas cartridge having a threaded neck to fracture a frangible seal of the gas cartridge upon actuation of the squib, comprising in combination:

a body having a forward end and a rearward end with a longitudinal hole extending therethrough, said longitudinal hole in said rearward end being threaded for threadably receiving the threaded neck of the gas cartridge, said body further including a vent hole in fluid communication with said longitudinal hole for venting gas from the cartridge when the frangible seal thereof is fractured;

a thin membrane positioned transversely in said longitudinal hole forward of said vent hole for hermetically sealing said longitudinal hole;

a pierce pin reciprocatably positioned in said longitudinal hole forward of and in alignment with said thin membrane and the frangible seal of the gas cartridge for piercing said thin membrane and the frangible seal when urged rearwardly;

means for positioning the squib in said longitudinal hole forward of said pierce pin to forceably urge said pierce pin rearwardly upon actuation of the squib; and, a cap connected to said forward end of said body to secure said pierce pin and squib in said longitudinal hole.

2. The inflator adaptor as set forth in claim 1, further including a threaded boss having a forward end and a rearward end with said longitudinal hole extending therethrough, wherein said rearward end of said threaded boss is threaded into said forward end of said body, wherein said cap is threaded onto said forward end of said threaded boss, and wherein said thin membrane is positioned in said longitudinal hole in said boss.

3. The inflator adaptor as set forth in claim 1, wherein said vent hole is positioned transverse to said longitudinal hole.

4. The inflator adaptor as set forth in claim 1, wherein electrical leads of the squib extend through a hole in said cap allowing electrical energy to be supplied to the squib to atuate the squib.

5. The inflator adaptor as set forth in claim 4, wherein said hole in said cap is sealed.

6. The inflator adaptor as set forth in claim 1, wherein said cap comprises a recess for seating said squib therein.

* * * * *